US005274207A

United States Patent [19]

Griffith

[11] Patent Number: 5,274,207

[45] Date of Patent: Dec. 28, 1993

[54] INDUCTION HEATER

[75] Inventor: John T. Griffith, Mold, United Kingdom

[73] Assignee: Electricity Association Technology Limited, United Kingdom

[21] Appl. No.: 743,512

[22] Filed: Aug. 12, 1991

[30] Foreign Application Priority Data

Aug. 13, 1990 [GB] United Kingdom ..... 9017702

[51] Int. Cl.[5] ..... H05B 6/10; H05B 6/64

[52] U.S. Cl. ..... 219/10.491; 219/10.51; 219/10.61 A; 219/10.57; 219/10.75; 219/10.77; 219/10.79; 336/73; 336/174

[58] Field of Search ..... 219/10.491, 10.51, 10.57, 219/10.61 A, 10.65, 10.75, 10.79, 10.69, 10.77, 10.493; 336/73, 174, 175

[56] References Cited

U.S. PATENT DOCUMENTS 3,107,268 10/1963 Kraus ..... 219/10.491
3,129,459 4/1964 Kullgren et al. ..... 219/10.491
4,629,844 12/1986 Griffith et al. ..... 219/10.51
4,843,201 6/1989 Griffith ..... 219/10.491
4,870,239 9/1989 Radcind ..... 219/10.75

FOREIGN PATENT DOCUMENTS 9017702 9/1985 United Kingdom ..... 219/10.49 R
2163930 3/1986 United Kingdom ..... 219/10.491

*Primary Examiner*—Bruce A. Reynolds
*Assistant Examiner*—Tu Hoang
*Attorney, Agent, or Firm*—Kinney & Lange

[57] ABSTRACT

An induction heater for heating a material is described which has an alternating current carrying conductor 30 extending along an axis of rotation. Mounted about the axis are containers 32 which rotate about the axis and hold the material to be heated. A core 34 is provided encircling the alternating current carrying conductor 30. The core 34 guides the magnetic flux resulting from an alternating current flowing in the conductor 30 to induce a current in the inner sleeve 38 between the conductor 30 and core 34. Current flowing in the inner sleeve 38 is conducted to end plates 40 and 42 and through the containers 32. The containers 32 are heated by the electrical current induced by the magnetic flux in the core 34.

9 Claims, 8 Drawing Sheets

INDUCTION HEATER

BACKGROUND OF THE INVENTION

The present invention relates to an induction heater wherein material is heated by contact with an inductively heated heating element.

GB 2163930 (The Electricity Council) discloses an induction heater having an alternating current carrying conductor extending along an axis. A core means substantially encircles said axis to guide magnetic flux resulting from an alternating current in the conductor. The heating element is an electrically conducting closed loop which encircles the magnetic flux in the core means and so is heated by electrical current induced therein.

Two of the embodiments disclosed in GB 2163930 are shown in FIGS. 1 and 2 of the present specification. In the embodiment of FIG. 1, the conductor 1 forms an axis about which is provided a ferromagnetic core 4. The core 4 is enclosed within a metal skin formed from concentrically aligned inner cylinder 5 and outer cylinder 7 and end plates 6 and 9. In this way, the skin forms a closed electrically conducting loop about the core 4. Alternating currents set up in the conductor 1 by toroidally wound transformer 8 set up an alternating magnetic flux which is guided by the core 4. In turn, the alternating flux in core 4 induces currents to flow around the above mentioned electrically conducting closed loop. Material to be heated is placed within the inner cylinder 5 and is heated by the energy produced in the cylinder by the induced currents. The structure comprising the cylinders 5 and 7 and core 4 can be rotated in the direction of the arrow A. In this way the material to be heated is moved into and out of contact with the cylinder 5 to allow uniform transfer of the heat from the cylinder to the material to be heated.

FIG. 2 shows a continuous flow induction heater. A motor 21 rotates a screw structure 22 in the direction of the arrow A. The screw structure 22 comprises an outer wall 23 which has a spiral slot cut in it to receive screw flight 24. The structure 22 also has an inner wall 25. A toroidal ferromagnetic core 26 is sandwiched between the inner and outer walls 23, 25. An electrically conducting conductor 1, corresponding to that shown in FIG. 1 runs along the axis of the structure 22. As in the embodiment of FIG. 1, a magnetic flux is induced in the core 26 by an alternating current in the conductor 1; this magnetic flux, in turn, induces electrical currents to flow in the walls 23, 25 and the screw flight 24 of the structure 22. The structure 22 is located within a can 28 having an inlet 29 and outlet 30 as shown. Consequently material entering at 29 contacts the structure 22 and is urged towards outlet 30 by the screw flight 24 as the structure 22 is rotated. The material is heated while in contact with the structure 22.

SUMMARY OF THE INVENTION

It is an object of the present invention to provide an improved induction heater.

According to the present invention there is provided an induction heater for heating a material, the induction heater comprising:

an alternating current carrying conductor extending along an axis;

at least one container for holding a material to be heated and mounted for rotation about said axis;

a core means between said at least one container and said axis, the core means substantially encircling said axis to guide magnetic flux resulting, in use, from the alternating current;

and at least one heating element for contacting and transferring heat to material to be heated, said at least one heating element comprising an electrically conducting current loop encircling the core means and being heated by electrical current induced by magnetic flux in the core means.

In contrast to the prior art embodiment of FIG. 1, the induction heater of the present invention has an improved power factor because the core means is closer to the alternating current carrying conductor. In addition, the core means, because of its position in the induction heater, can be of reduced volume and weight. A further advantage is that the energy required to rotate the core means is reduced, again because of the position of the core means in the induction heater of the present invention. Furthermore, the outer wall of the drum can be constructed to be readily dismantled for cleaning or major servicing.

In comparison with the prior art embodiment of FIG. 2, relative movement of the heating element and the material to be heated in the induction heater of the present invention is caused by rotation of the whole drum.

BRIEF DESCRIPTION OF THE DRAWINGS

Embodiments of the present invention will now be described, by way of example only, and with reference to the accompanying drawings in which.

DETAILED DESCRIPTION OF THE PREFERRED EMBODIMENTS

Figure 1:
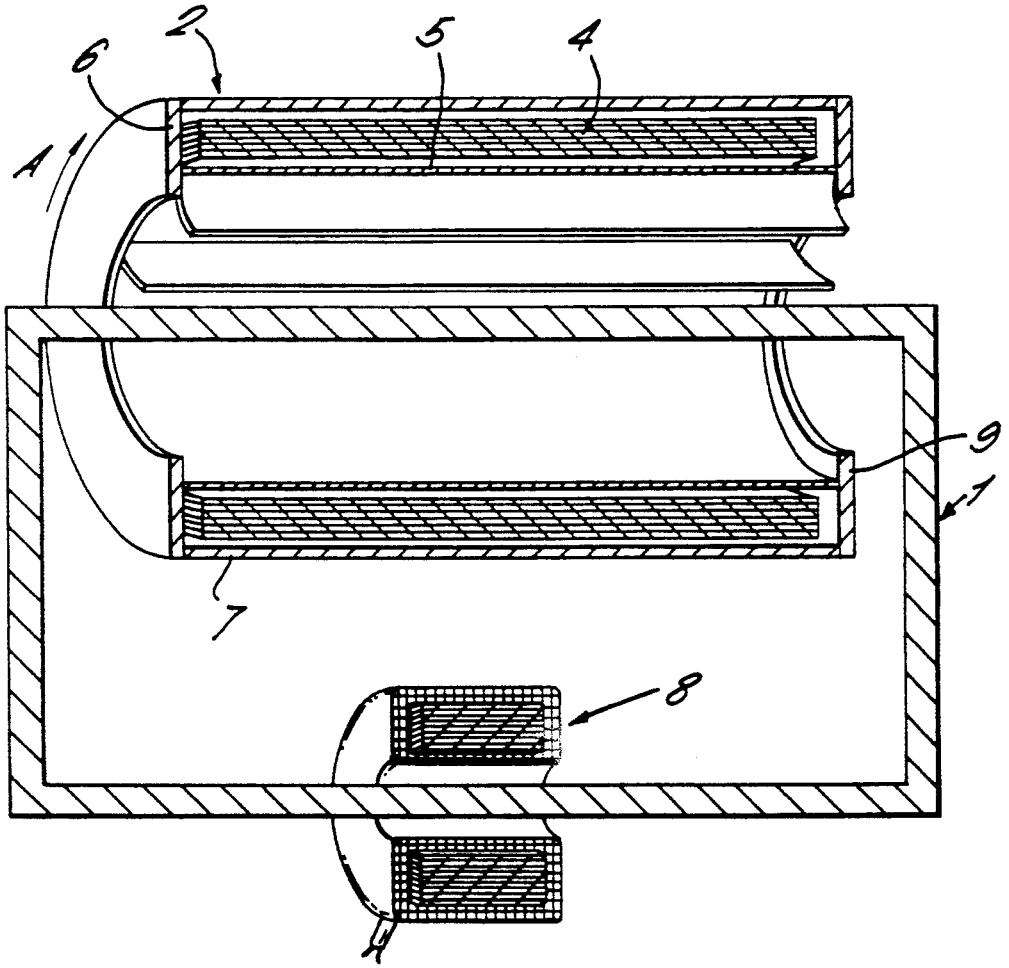
FIG. 1. PRIOR ART
FIGS. 1 and 2 show prior art induction heaters as described previously.
Figure 2:
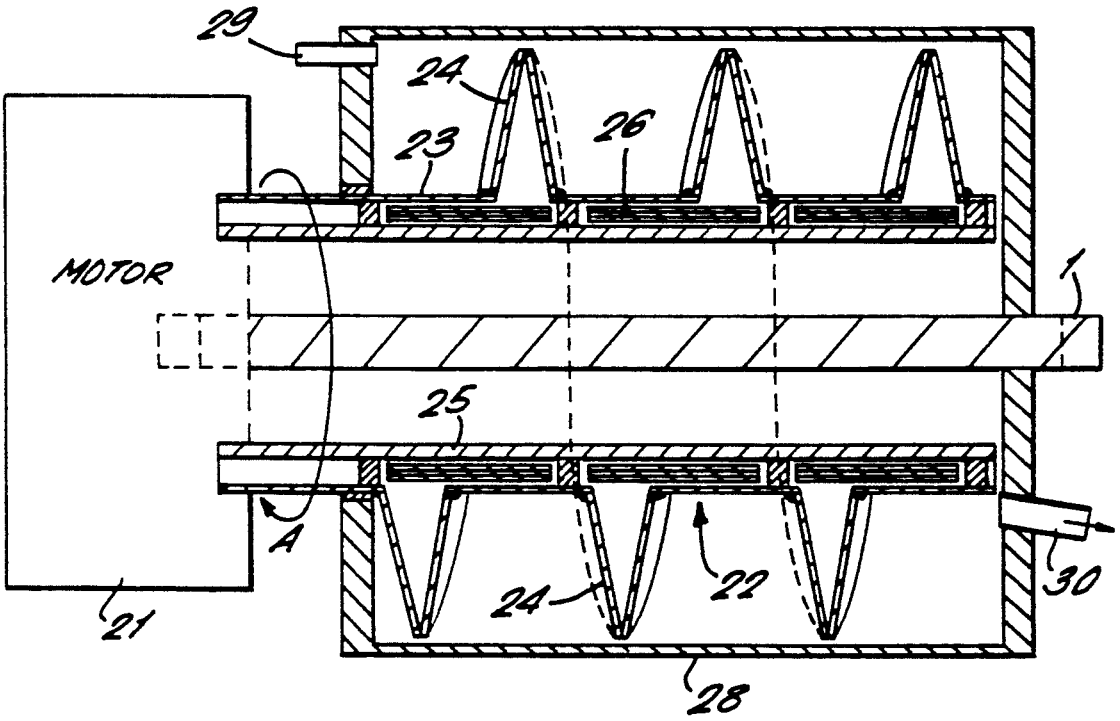
FIG. 2. PRIOR ART
Figure 3:
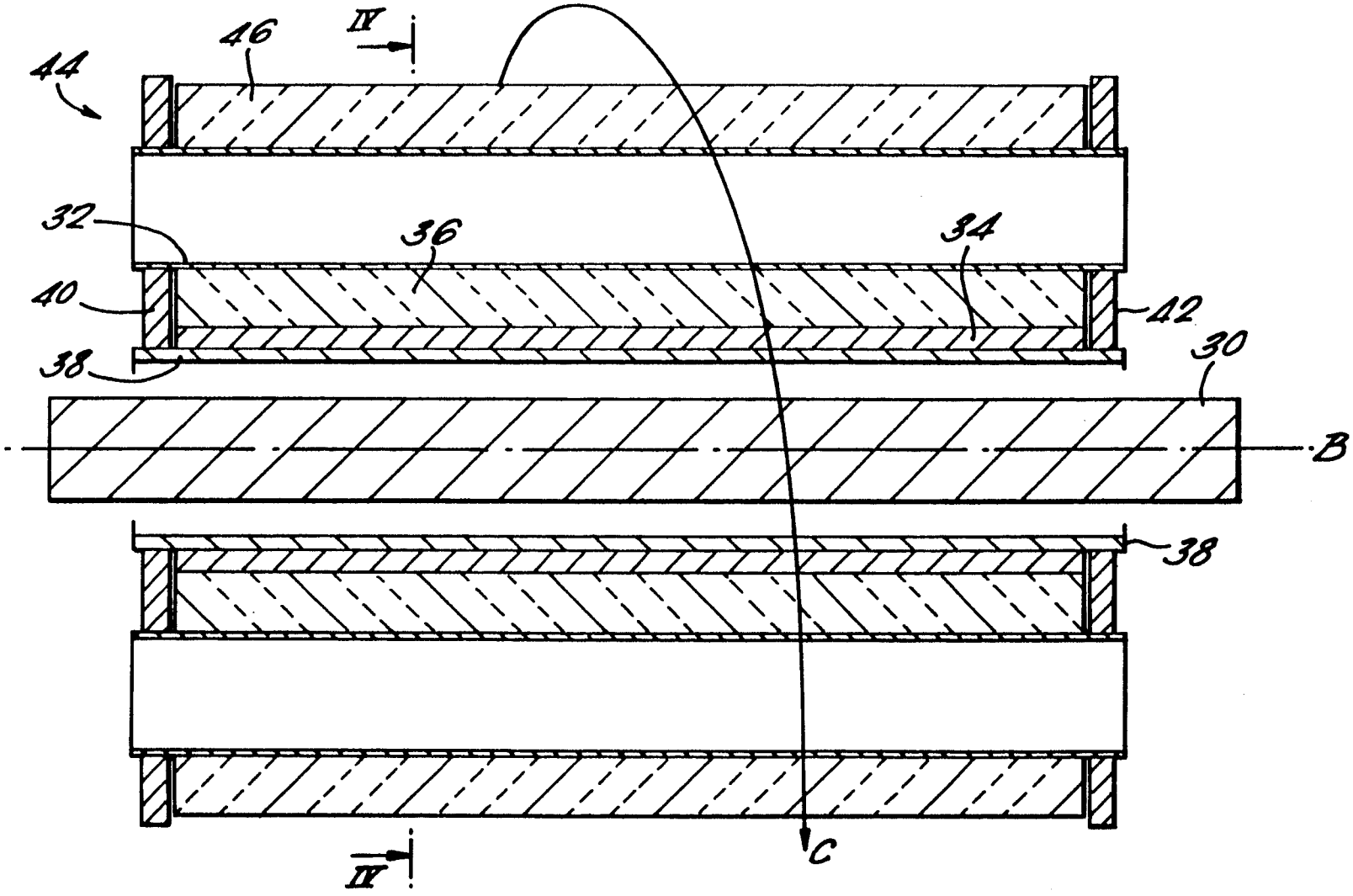
FIGS. 3 and 4 are cross-sections of a first embodiment of an induction heater provided in accordance with the present invention.
Figure 4:
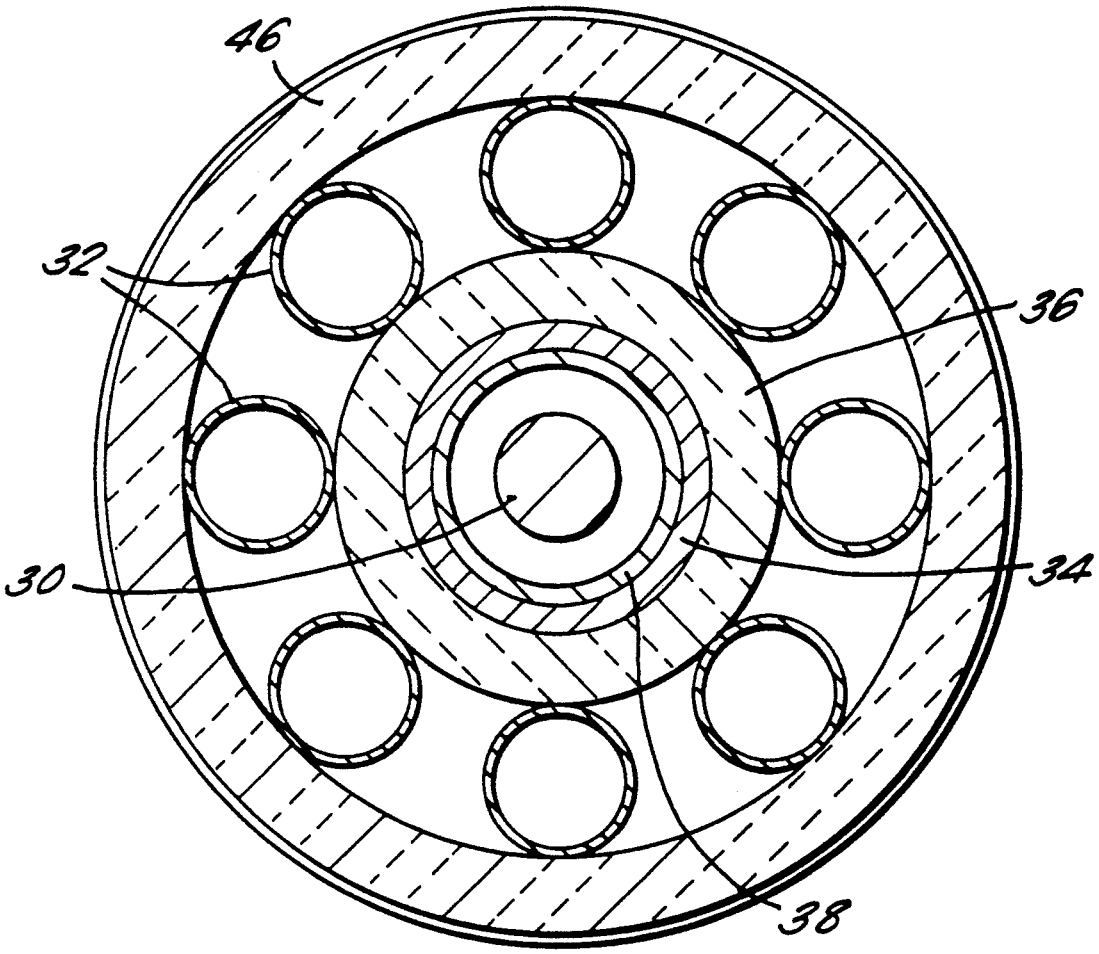

FIG. 3 is a schematic cross-section of a rotatable induction heater in a plane including the axis of rotation B of the induction heater and FIG. 4 is a cross-section along the line IV—IV of FIG. 3. As shown in FIGS. 3 and 4, the induction heater includes a conductor 30 capable of conducting alternating electric current which extends along the axis of rotation B of the induction heater. The conductor 30 which is typically made of copper and may be laminated to reduce its AC resistance is connected to a source of alternating current (not shown). Extending parallel to the conductor 30 are a plurality of tubes 32 for holding the material to be heated. The tubes 32 shown are of circular cross-section but it is envisaged that there may be advantage in using tubes of non-circular cross-section. Between the tubes 32 and the conductor 30 is provided an annular ferromagnetic core 34. The core 34 is thermally insulated from the tubes 32 by insulation 36. An inner sleeve 38 and end plates 40, 42 (not shown in FIG. 4) together with the tubes 32 define a closed electrically conducting loop about the core 34. The inner sleeve 38 and end plates 40, 42 are preferably made of a material such as copper which has a relatively low electrical resistance while the tubes 32 are preferably made of a material such a steel, which has the necessary mechanical strength and heat resistant qualities and also has an electrical resistivity such that the electrical resistance of the tubes is higher (preferably substantially higher) than the electrical resistance of the inner sleeve 38 and end plates 40, 42. The outer boundary of the drum 44 enclosing the tubes 32, core 34 and conductor 30 is defined by a cylinder 46 of thermal insulation.

The material to be heated is inserted into the tubes 32. An alternating current is set up in the conductor 30 inducing an alternating magnetic flux which is guided by the core 34. The alternating magnetic flux induces currents to flow in the closed electrically conducting loop consisting of the tubes 32, inner sleeve 38 and end plates 40, 41.

The induced currents produce heat by Joule heating and, so the walls of the tubes 32 are effective as heating elements to heat the material contained within the tubes 32. With the preferred material construction outlined previously, the majority of the heat is produced in the tubes 32 which are separated from the core 34 by the thermal insulation 36. In this way, the temperature of the core 34 is kept below the temperature of the tubes 32 and so the maximum operating temperature of the heater is not limited by the Curie temperature of the core 34.

The whole drum 44 is rotated about the axis B in the direction indicated by the arrow C. The material to be heated is thus moved into and out of contact with the walls of the tubes 32 to allow uniform transfer of heat from the tubes to the material to be heated.

Because of the temperatures produced by the tubes 32 effective as heating elements, the tubes 32 expand substantially during operation of the induction heater. Accordingly, the induction heater must be constructed so as to tolerate this expansion.

Figure 5:
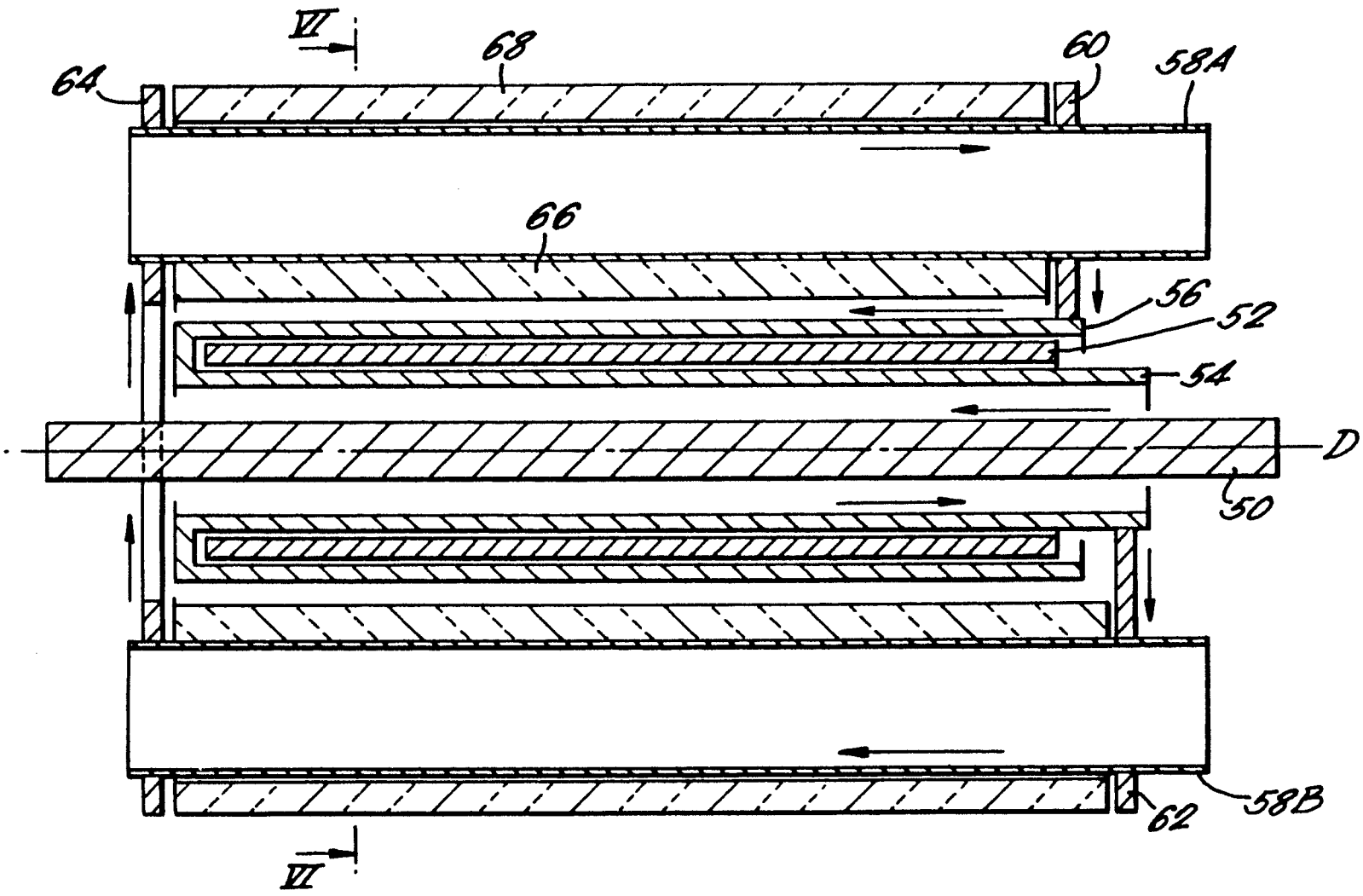
FIGS. 5 and 6 are cross-sectional views of a second embodiment of an induction heater provided in accordance with the present invention.
Figure 6:
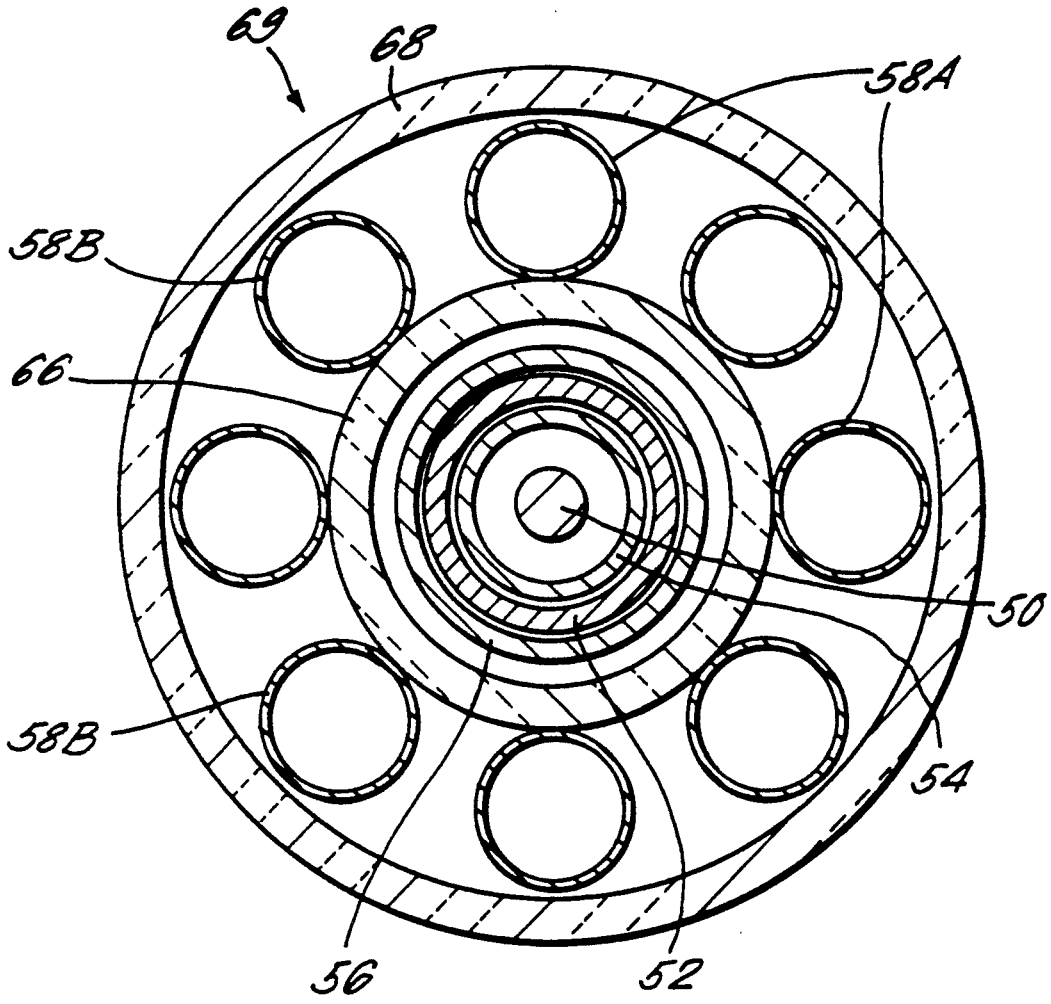

FIGS. 5 and 6 show a modified version of the induction heater of FIGS. 3 and 4. FIG. 5 is a schematic cross-section of the induction heater along a plane including the axis of rotation D of the induction heater and FIG. 6 is a schematic cross-section along the line VI—VI of FIG. 5. As in the embodiment of FIGS. 3 and 4, an alternating current conductor 50 extends along the axis of rotation D. Parallel to the conductor 50 is provided an annular ferromagnetic core 52. On either side of the core 52 are an inner sleeve 54 and an outer sleeve 56 of electrically conducting material which are joined together at one end. A plurality of tubes are provided for holding the material to be heated. The tubes shown are of circular cross-section but it is envisaged that there may be advantage in using tubes of non-circular cross-section. The tubes are divided into two groups 58A and 58B, extending parallel to the conductor 50 and are positioned outward of the core 52. Tubes of one group 58A are electrically connected by one end plate 60 to the outer sleeve 56 whilst tubes of the other group 58B are electrically connected to the inner sleeve 54 by an end plate 62. These electrical connections are made at one end of the induction heater. At the other end of the induction heater, an end plate 64 electrically connects the ends of all the tubes 58A, 58B together. In this way, an electrically conducting closed loop is formed in which the tubes of the group 58A are connected in series with the tubes of the group 58B. The overall resistance of the electrically conducting loop is substantially increased, in comparison with the embodiment of FIGS. 3 and 4 in which the tubes were all electrically connected in parallel, thus enabling better electrical performance and so heating effect without the need for thin section tubes (to increase the resistance of each tube). Furthermore, as the tubes 58A, 58B, which may be of a different material to that of the inner and outer sleeves 54, 56, are not mechanically connected to both ends of the inner and outer sleeves 54, 56, the problems of differential expansion with increase in temperature are thereby reduced. A sliding support (not shown) is provided to support the ends of the inner and outer sleeves 54, 56 which are not connected to the tubes 58A, 58B. FIGS. 5 and 6 also show two cylinders 66, 68 which thermally insulate the tubes 58A, 58B. The outer cylinder 68 defines the outer boundary of the drum 69 enclosing the conductor 50, the tubes 58A, 58B and the core 52.

The operation of the embodiment of FIGS. 5 and 6 is similar to that of the embodiment of FIGS. 3 and 4. As mentioned previously, in the closed electrically conducting loop, the tubes 58A are electrically connected in series with the tubes 58B. The broad arrows in FIG. 5 indicate instantaneous direction of flow of the current induced in the closed electrically conducting loop. The whole drum 69 is rotated about the axis D. Thus, the material to be heated is moved into and out of contact with the walls of the tubes 58A, 58B to allow uniform transfer of heat from the tubes 58A, 58B, effective as heating elements, to the material to be heated.

With both the embodiments of the induction heater provided in accordance with the present invention described, individual tubes may easily be removed for service or repair.

Figure 7:
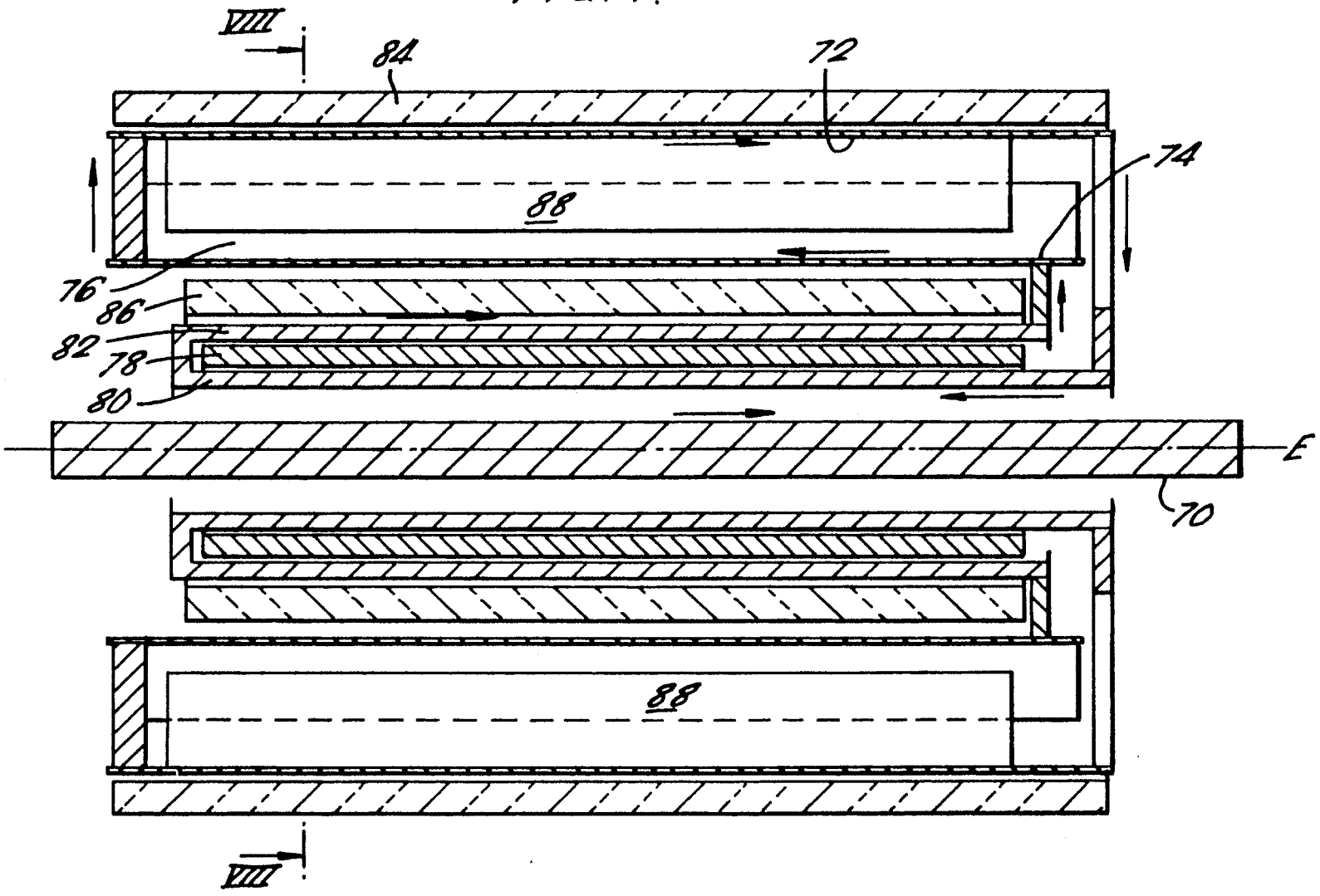
FIGS. 7 and 8 are cross-sectional views of a third embodiment of an induction heater provided in accordance with the present invention.
Figure 8:
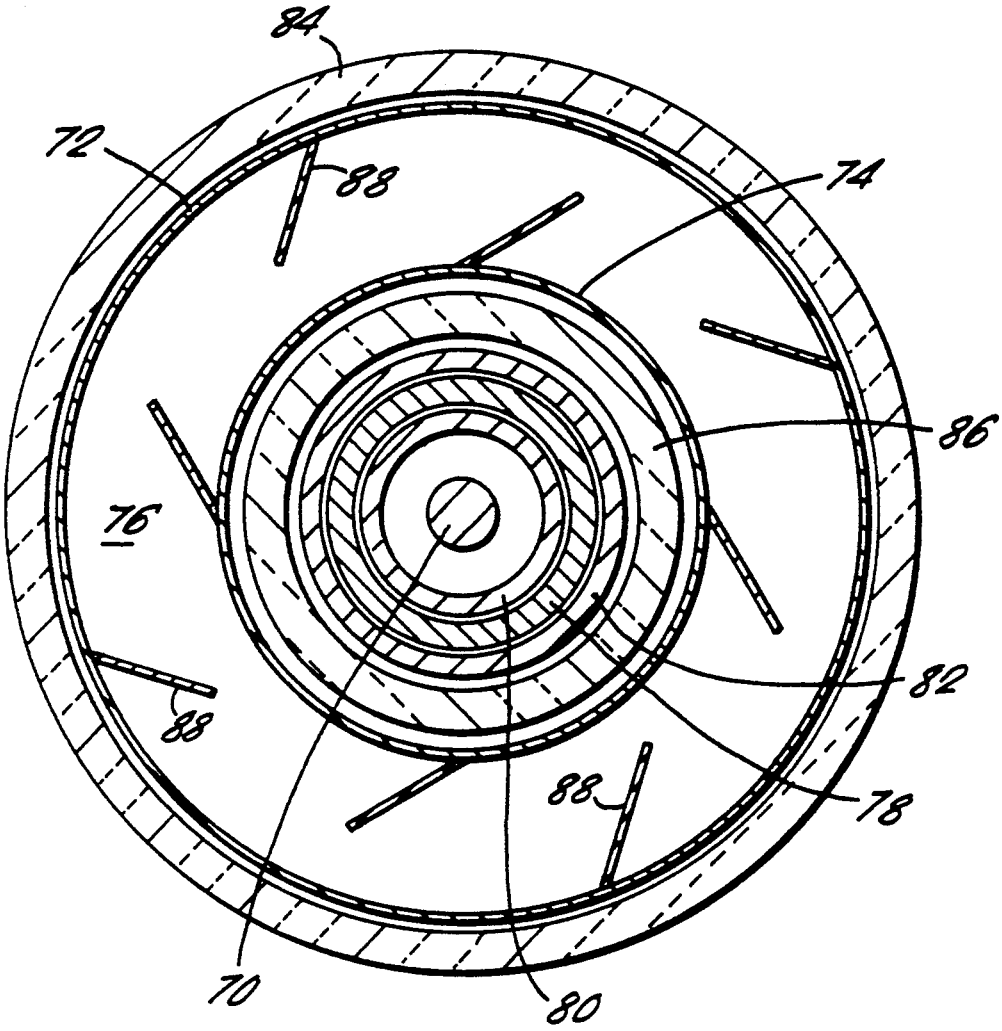

FIG. 7 is a schematic cross-section of a third embodiment of the present invention on a plane including the axis of rotation E of the embodiment. FIG. 8 is a cross-section of the embodiment of FIG. 7 along the line VIII—VIII of FIG. 7. As with the other embodiments described, the heater of FIG. 7 includes a conductor 70 extending along the axis of rotation E. Surrounding the conductor 70 are an outer drum 72 and an inner drum 74, both made of an electrically conducting material defining a cavity 76 in which the material to be heated is placed. An annular ferromagnetic core 78 is positioned between the conductor 70 and the cavity 76. An inner sleeve 80 and an outer sleeve 82 of electrically conducting material surround the core 78 and are joined together at one end. At the other end, the inner sleeve 80 and outer sleeve 82 are respectively electrically connected to the outer drum 72 and inner drum 74, thus forming a closed electrically conducting loop about the core 78.

The broad arrows in FIG. 7 indicate instantaneous direction of flow of the current induced in the closed electrically conducting loop. As with the previous embodiments of the present invention, alternating current set up in the conductor 70 produces an alternating magnetic flux which is guided by the core 78. In turn, the alternating flux in core 78 induces currents to flow around the electrically conducting closed loop, causing Joule heating. Preferably, the resistance of the inner drum 74 and outer drum 72 is greater than the resistance of the inner sleeve 80 and outer sleeve 82 so that more of the power dissipated as heat in the closed electrically conducting loop is dissipated in the inner drum 74 and outer drum 72 which are effective as heating elements to heat the material contained in the cavity 76. Cylinders of thermal insulation 84, 86 are provided adjacent the outer drum 72 and inner drum 74 as indicated. The inner cylinder of thermal insulation 86 further enables the core 78 to be maintained below its Curie temperature.

The whole structure shown in FIGS. 7 and 8 can be rotated about the axis of rotation E so that the material to be heated is moved into and out of contact with the inner drum 74 and outer drum 72 to allow uniform transfer of heat from the drums to the material to be heated. Fin members 88 are advantageously provided electrically connected to either one of the inner drum 74 and outer drum 72, so that they form part of the electrically conducting closed loop. This heating of the fin members 88 is advantageous because the material to be heated is in contact with a large surface area of heating element and is continually agitated or mixed.

Modifications to the embodiments described hereinbefore within the scope of the present invention will be apparent to those skilled in the art.

I claim:

1. An induction heater for heating a material, the induction heater comprising:

an alternating current carrying conductor extending along an axis;

at least one container for holding a material to be heated and mounted for rotation about said axis, said at least one container comprising a plurality of tubes extending parallel to said axis;

a core means between said at least one container and said axis, the core means substantially encircling said axis to guide magnetic flux resulting, in use, from the alternating current;

and at least one heating element for contacting and transferring heat to material to be heated, said at least one heating element comprising an electrically conducting closed loop encircling the core means and being heated by electrical current induced by magnetic flux in the core means.

2. An induction heater according to claim 1, in which at least one heating element provides at least one wall of at least one wall of at least one container, wherein each of said walls extend along said axis.

3. An induction heater according to claim 1 wherein said at least one container is defined by an inner drum and an outer drum.

4. An induction heater according to claim 3, wherein said inner drum and said outer drum are electrically connected in series.

5. An induction heater according to claim 1, wherein said plurality of tubes are electrically connected in parallel.

6. An induction heater according to claim 1, wherein said plurality of tubes are formed of a first group of tubes and a second group of tubes, said first group of tubes being electrically connected in series with said second group of tubes.

7. An induction heater according to claim 1, wherein said electrically conducting closed loop includes a first and a second electrically conducting sleeve arranged coaxially and electrically connected to each other at one end thereof, and means to electrically connect said first and second sleeves at a second end thereof to said at least one heating element.

8. An induction heater according to claim 8, wherein said core means is positioned between said first and said second sleeve.

9. An induction heater according to claim 1, wherein said core means is thermally insulated from said at least one heating element.

* * * * *

UNITED STATES PATENT AND TRADEMARK OFFICE

CERTIFICATE OF CORRECTION

PATENT NO. : 5,274,207

DATED : December 28, 1993

INVENTOR(S) : JOHN T. GRIFFITH

It is certified that error appears in the above-indentified patent and that said Letters Patent is hereby corrected as shown below:

Col. 3, line 19, delete "and,", insert --and--

Col. 6, line 8, after "claim 1", insert --,--

Col. 6, line 29, delete "claim 8", insert --claim 7--

Signed and Sealed this

Twenty-first Day of June, 1994

*Attest:*

Bruce Lehman

BRUCE LEHMAN

*Attesting Officer*

*Commissioner of Patents and Trademarks*